United States Patent [19]

Pickens

[11] 4,218,028

[45] Aug. 19, 1980

[54] BRACKET FOR SUPPORTING A ROLL OF MATERIAL

[75] Inventor: Jay W. Pickens, Fort Worth, Tex.

[73] Assignee: D/FW Plastics, Bedford, Tex.

[21] Appl. No.: 69,635

[22] Filed: Aug. 27, 1979

[51] Int. Cl.[3] ..... A47K 10/22

[52] U.S. Cl. ..... 242/55.2; 242/68.4; 242/129.51; 248/201; 248/225.1; 248/239

[58] Field of Search ..... 242/55.2, 55.3, 55.53, 242/55.55, 68.4, 68.5, 68.6, 68, 129.51, 129.53; 248/201, 205 A, 239, 235, 227, 244, 225.1

[56] References Cited

U.S. PATENT DOCUMENTS

| | | | |
|---|---|---|---|
| 3,034,739 | 5/1962 | Barger | 242/68.4 |
| 3,759,191 | 9/1973 | Freeman | 248/239 |
| 3,804,358 | 4/1974 | Gunther | 248/239 |
| 4,099,681 | 7/1978 | House | 242/55.2 |

FOREIGN PATENT DOCUMENTS

| | | | |
|---|---|---|---|
| 371845 | 4/1923 | Fed. Rep. of Germany | 248/239 |

*Primary Examiner*—George F. Mautz

*Attorney, Agent, or Firm*—Wofford, Fails & Zobal

[57] ABSTRACT

The bracket comprises two support members adapted to be secured to a wall or the like at spaced apart positions and two shaft means, each adapted to be removably coupled to one of the support members for supporting a roll of material for rotation between the two support members. Each support member comprises a body having a slot formed therein from one side to an opposite side. Each shaft means comprises a shaft portion adapted to be inserted into the axial opening at one end of the roll of material and a coupling portion having a slot formed therein from one side to an opposite side. A portion of the coupling portion of each shaft means is adapted to be removably received in the slot of one of the support members and a portion of the body of the corresponding support member is adapted to be removably received in the slot of the coupling portion of the shaft means whereby the shaft means may be removably interlocked with the support member. The two support members are identical and the two shaft means are identical.

5 Claims, 3 Drawing Figures

Fig. 1
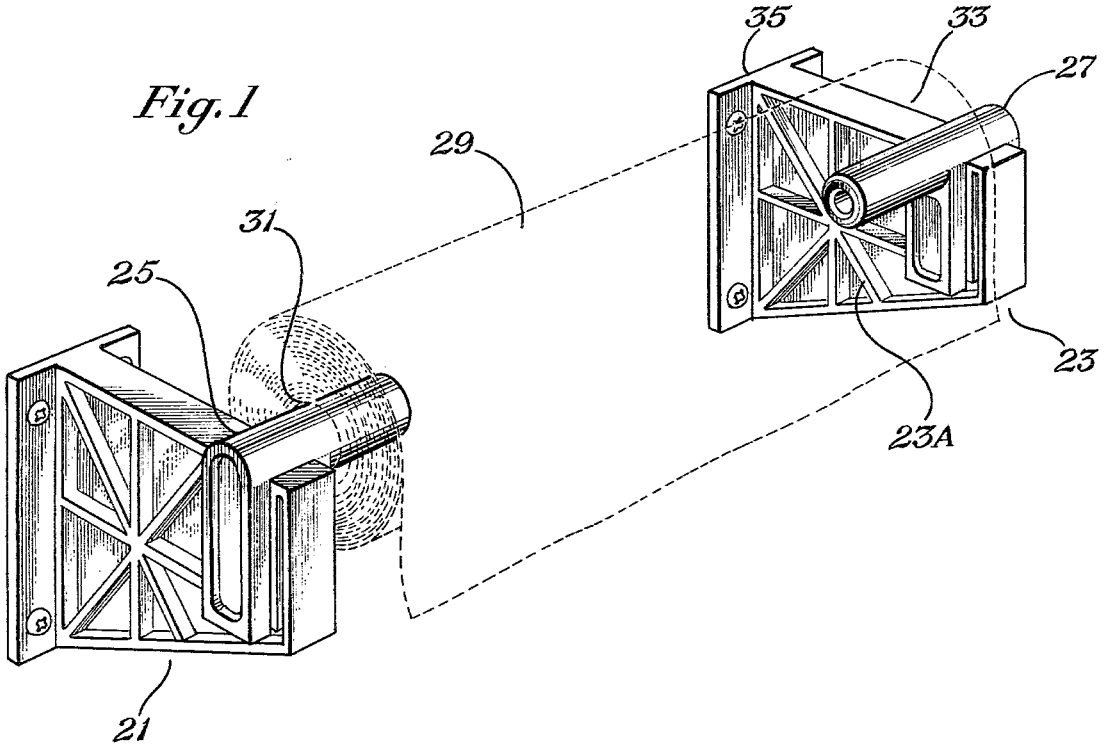
Fig. 3
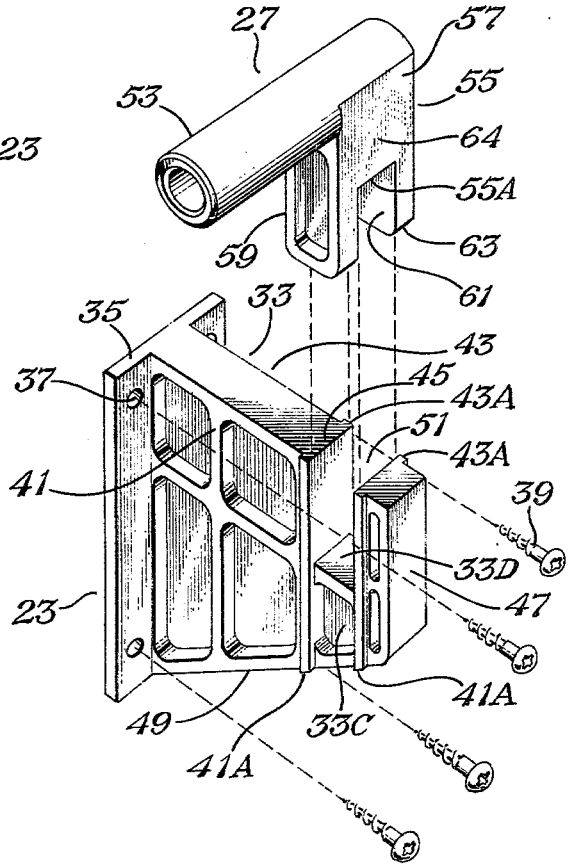
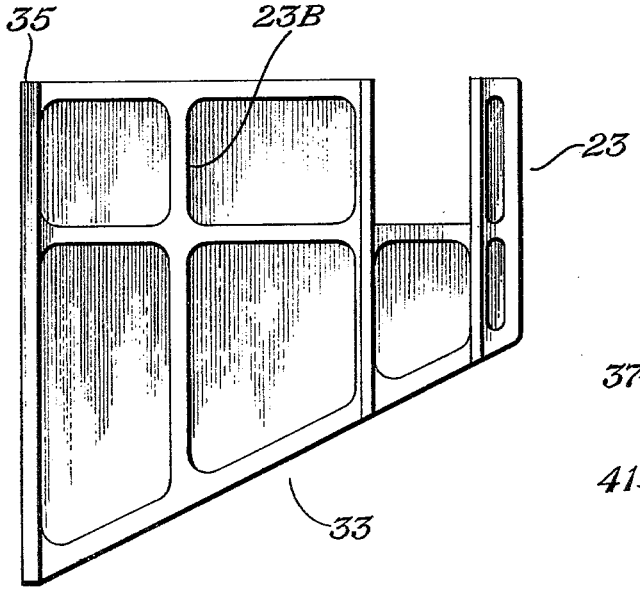
Fig. 2

BRACKET FOR SUPPORTING A ROLL OF MATERIAL

FIELD OF THE INVENTION

The present invention relates to a bracket for rotatably supporting a roll of wound material such as a roll of bags, paper, etc.

In the past few years, the use of plastic trash bags has greatly increased and is expected to increase even more in the future. Many manufacturers form the bags as a continuous sheet with perforations to allow individual bags to be torn off of the sheet which is wound in a roll. Generally, a roll of bags is sold in a box and the user tears the bags off of the roll while in the box. This is very inconvenient and a need exists for an effective bracket to rotatably support the roll to facilitate tearing the bags from the roll.

SUMMARY OF THE INVENTION

It is an object of the present invention to provide a novel and effective bracket for rotatably supporting a roll of trash bags as well as rolls of other types of bags, rolls of paper, etc.

It is a further object of the present invention to provide a strong and easy to use bracket for rotatably supporting a roll of material.

The bracket comprises two support members adapted to be secured to support structure at spaced apart positions and two shaft means, each adapted to be removably coupled to one of the support members for supporting a roll of material for rotation between the two support members. Each support member comprises a body having a slot formed therein from one side to an opposite side. Each shaft means comprises a shaft portion adapted to be inserted into the axial opening at one end of the roll of material and a coupling portion having a slot formed therein from one side to an opposite side. A portion of the coupling portion of each shaft means is adapted to be removably received in the slot of one of the support members and a portion of the body of the corresponding support member is adapted to be removably received in the slot of the coupling portion of the shaft means whereby the shaft means may be removably interlocked with the support member.

In a futher aspect, the two support members are identical and the two shaft means are identical.

BRIEF DESCRIPTION OF THE DRAWINGS

FIG. 1 is a perspective view of the bracket of the present invention.

FIG. 2 is a side view of one of the support members of the bracket of the present invention.

FIG. 3 illustrates the manner in which one of the shaft members is fitted to or removed from a support member.

DESCRIPTION OF THE PREFERRED EMBODIMENTS

Referring now to FIG. 1 of the drawings, the bracket of the present invention comprises two identical support members 21 and 23 adapted to be secured to a wall or the like at spaced apart positions and two identical shaft members 25 and 27. Each of the shaft members is adapted to be removably secured to one of the support members for supporting a roll of material 29 for rotation between the support members. The roll of material 29 may be a roll of wound tear away bags, a roll of wound paper having tear away sections, etc. The sheet of material is wound such that it has an aperture 31 extending axially therethrough or is wound around a paper tube having an aperture 31 extending therethrough.

The support members will be described with reference to support member 23. In FIGS. 2 and 3, the support member 23 is substantially the same as support member 23 of FIG. 1 except for the different pattern of structural webbing. In FIG. 1, the structural webbing 23A crosses in the center while the webbing 23B in FIGS. 2 and 3 form a grid pattern. It is to be understood that preferably the support members produced will have the same webbing pattern for example either that of FIG. 1 or that of FIGS. 2 and 3.

As seen in the drawings, the support member 23 comprises a body portion 33 joined to a base 35 which extends at right angles to the plane of the body portion 33. The base 35 has four apertures 37 formed therethrough for receiving four screws 39 for attaching the support member to a vertical wall or other structure. The body 33 extends outward from the base and has two opposite facing sides 41 and 43, a top edge 45, an outward edge 47, and a bottom edge 49. In the embodiment of FIGS. 2 and 3 sides 41 and 43 are flat except for ridges 41A and 43A. A deep slot 51 is formed in the top edge 45 between sides 41 and 43.

The shaft members will be described with reference to the shaft member 27. It comprises a cylindrical shaft 53 adapted to be inserted into the aperture 31 of the roll 29 at one end and a coupling portion 55 for coupling the shaft member to the body of one of the support members at right angles to the plane of the body. Portion 55 has two opposite flat sides 57 and 59 and a slot 61 has formed in its lower end 63.

The coupling portion 55 has a size such that the portion 64 above the slot 61 portion may be removably received within the slot 51 of support member 23 and the portion 33C of the body 33 of the support member 23 below the slot 51 has a size such that it may be removably received within the slot 61 of the shaft member 27 whereby the shaft member 27 may be interlocked with the support member 23 as shown in FIG. 1. When interlocked, shaft 53 is at right angles with respect to the thin plane of body 33 of support member 23; body portion 33C is within slot 61; body portion 64 is within slot 51; and slots 51 and 61 are at right angles with respect to each other. Full interlock occurs when surface 33D engages surface 55A.

Since the support member 21 is identical to support member 23 and since shaft member 25 is identical to shaft member 27, shaft member 25 may be interlocked with support member 21 in the same manner as shaft member 27 is interlocked with support member 23. It is to be understood that shaft member 27 may be used with support member 21 and shaft member 25 used with support member 23.

In use, support members 21 and 23 will be secured to a wall or other structure at spaced apart positions sufficient to freely receive the roll 29. The shafts 53 of the shaft members 25 and 27 will be inserted within the aperture 31 at opposite ends of the roll and then interlocked with support members 21 and 23 as shown in FIG. 1 and described above. The aperture 31 will loosely receive the shafts 53 to allow the roll to freely turn thereon. After the roll is used up, a new one may be inserted by removing the shaft members 25 and 27 from the support members, inserting the shafts within the aperture of the new roll at opposite ends and interlocking the shaft members with the support member. The fit between shaft member portion 64 and slot 51 and between support member body portion 33C and slot 61 will be tight but removable. Thus the bracket is strong enough to support rolls of the thick plastic trash bags and to allow them to be torn off of the roll and yet is easy to use and readily allows replacement rolls to be inserted in the bracket.

In the preferred embodiment, the support members 21 and 23 and the shaft members 25 and 27 are formed of plastic by injection molding. Since the support members 21 and 23 are identical and since the shaft members 25 and 27 are identical, only two molds are needed for making the four pieces thus reducing costs. The plastic employed for forming the members of the bracket may be propylene.

I claim:

1. A bracket for rotatably holding a roll of material of the type having an axial opening formed in opposite ends, comprising:

two support members adapted to be secured to support structure at spaced apart positions, each support member comprising a body having a slot formed therein from one side to an opposite side, two shaft means each adapted to be removably coupled to one of said support members for supporting a roll of material for rotation between said two support members, each shaft means comprising a shaft portion adapted to be inserted into the axial opening at one end of the roll of material and a coupling portion for coupling the shaft means to one of said support members such that the shaft means extends transversely with respect to the support member, said coupling portion of each shaft means having a slot formed therein from one side to an opposite side, a portion of the coupling portion of each shaft means being adapted to be removably received in the slot of the body of one of the said support members and a portion of the body of the corresponding support member being adapted to be removably received in the slot of the coupling portion of the shaft means whereby the shaft means may be removably interlocked with the support member.

2. The bracket of claim 1 wherein:

each support member has a base portion extending transversely with respect to its body, the base portion having apertures formed therethrough for receiving attaching means for attaching the support member to support structure.

3. The bracket of claim 2 wherein:

said shaft portion of each shaft means is cylindrical in shape.

4. The bracket of claim 3 wherein:

the opposite sides of the body of each support member are generally flat, the opposite sides of the coupling portion of each shaft means are flat.

5. The bracket of claims 1, 2, 3, or 4 wherein;

said two support members are identical, and said two shaft means are identical.

* * * * *